US005916018A

United States Patent [19]

Watt

[11] Patent Number: 5,916,018

[45] Date of Patent: Jun. 29, 1999

[54] SHARPENER: ICESKATE BLADES, ICEBOAT AND BOBSLED RUNNERS

[76] Inventor: Allen Emmerson Watt, 167 Via Los Miradores, Redondo Beach, Calif. 90277

[21] Appl. No.: 08/918,077

[22] Filed: Aug. 25, 1997

[51] Int. Cl.[6] ..... B23F 21/03

[52] U.S. Cl. ..... 451/555; 76/83; 76/88

[58] Field of Search ..... 451/555, 558, 451/523, 524; 76/83, 82, 88

[56] References Cited

U.S. PATENT DOCUMENTS

| | | | |
|---|---|---|---|
| 73,118 | 1/1868 | Prettyman | 76/83 |
| 750,696 | 1/1904 | Price | 76/83 |
| 1,006,940 | 10/1911 | Haynes | 76/83 |
| 1,672,508 | 6/1928 | Vallery | 451/558 |
| 2,154,744 | 4/1939 | Hammond | 76/83 |
| 3,157,973 | 11/1964 | Chattillion | 451/558 |
| 5,189,845 | 3/1993 | Courchesne | 451/558 |

FOREIGN PATENT DOCUMENTS

| | | | |
|---|---|---|---|
| 158902 | 12/1932 | Switzerland | 76/83 |

*Primary Examiner*—Robert A. Rose
*Attorney, Agent, or Firm*—Oliff & Berridge, PLC

[57] ABSTRACT

A small hand-held device for shaping and sharpening of the ice-contact surfaces of skate blades and blade-type runners of bobsleds and iceboats. The sharpener has two means for guiding blades in its sharpening section: a) a fixed, non-adjustable slot in the body, or b) adjustable guide bars in a sheet-metal or a solid-material body model. The sharpener can also include a centering device for exact centering of the radiused abrader with the center of the skate blade regardless of the sharpening wear of the abrader.

5 Claims, 3 Drawing Sheets

X
X
4

SECTION X-X
4
3
9
5
10
12
6
1
7
8
2
13

5
12
1
7
14
13
(11)
(11)

6
(9)
2
8
(13)
3
9
10
11

3

2

11

2A

7

2B

11A

FIG. 5.
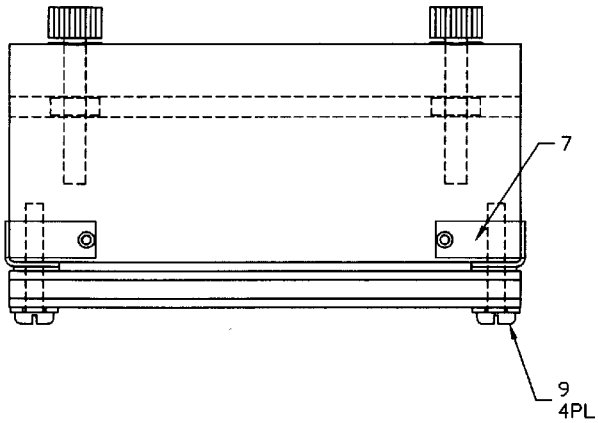
FIG. 6.
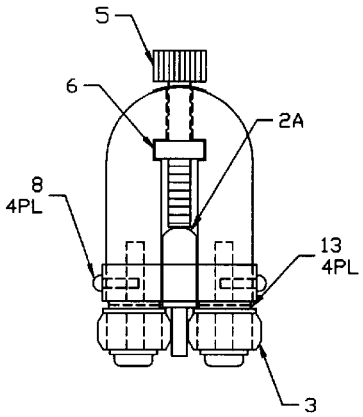
FIG. 7.
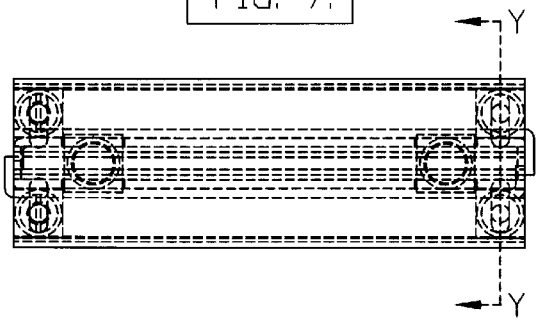
FIG. 8.
SECTION Y-Y
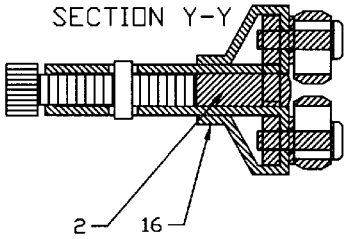
FIG. 9.
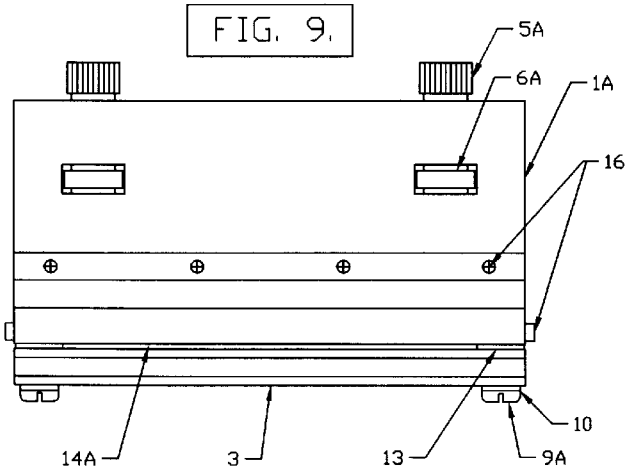
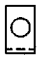
FIG. 27.
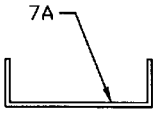
FIG. 28.

SHARPENER: ICESKATE BLADES, ICEBOAT AND BOBSLED RUNNERS

BACKGROUND—FIELD OF INVENTION

Terminology:

In the following, references to skates, blades, or skate blades apply also to bobsled and iceboat runners unless otherwise noted. Sharpener or sharpeners will refer to small hand-held devices used to maintain or create sharp-edged ice-contact surfaces of skates in a hollow (concave) or flat shape by sliding the device back and forth along the blade. Abrader refers to the abrasive or cutting item (file, emery-cloth, stone, etc.) that grinds or cuts the blades. Convex and concave, which refer to the shape of the abrader or blade hollow, are defined as "radius" or "radii" in decimal-inch values.

Variables that determine the radius values needed:

1. In hockey, the forward requires great maneuverability for very sharp starts, turns, and stops; the goalkeeper requires great stability and side-to-side stepping/sliding action. Smaller radius for the former player, larger radius or flat for the latter.
2. Speed skaters need a flat or large radius for maximum speed without sharp turns and with small variations for indoor smaller-turn rinks.
3. Figure skaters may have several pairs of skates with a variety of radii for success in "compulsory figures" and the strenuous jumps and spins of the axels and lutzs.
4. Added to the above are skaters' individual preferences as well as their choices depending on ice conditions (hard/soft, smooth/rough).

Optimum Sharpener Specifications

Based on the above many variables, the following describe the optimum requirements for all skate sharpeners:

A. Must have a self-aligning or simple-adjustment means to locate the center of the skate blade exactly in the center of the convex abrader.

B. If the abrader is a long round file, stone, or cylinder, etc., that must be rotated after a sharpening to obtain a fresh, true convex radius, the worn surface must not affect the exact centering as stipulated in Specification A.

C. Must be able to produce sharpened blade hollows of any radius value from 0.032" to the infinite value of flat.

D. Abrader components or surfaces that become worn out in sharpening should be available at low cost from local hardware or sports stores to compete easily with high-cost, inconvenient commercial machine grinding.

E. Guides for the skate blades must be easily and accurately adjusted to accommodate all skate blade widths and to allow for wear of the guides.

F. Simple, small pocket tools, such as nail files, folding knives, and screwdrivers, should be the only equipment needed to adjust, maintain, and replace parts.

G. The sharpener should be light in weight.

H. Sharpeners should not have sharp, protruding parts to damage clothing or harm the user.

I. Parts that may come loose or lost—like screws, nuts, or washers—should be standard hardware items.

J. The number of accurate sharpenings possible before replacement of the abrader or blade guides should be high for convenience and cost efficiency.

BACKGROUND—PRIOR ART

Patent Design Evaluation

The following is a comparative evaluation of four existing patents and this present patent application, all relative to the above "Specifications" section.

Detailed Assessment of the Four Patents by the Above Specifications

U.S. Pat. No. 3,431,597 of Bradley J. Anderson

A. and B.-lacks accurate, positive and repeatable centering of the abrader round stone 37 for the following reasons:

The stone is not a snug fit inside the round bore of the body 11 and progressively loosens as the area worn in each sharpening is turned to present a fresh, unworn surface to the skate blade.

Page three, paragraph one, refers to changes in the stone 27 diameter ("different convex curves") to vary the skate blade hollow. Because the body bore 21 has a fixed diameter, any change in stone diameter must be a reduced size, which will increase the inaccuracy of the centering.

C. This sharpener cannot produce large-radius skate hollows because of its limited body-bore diameter. A skate hollow radius of 108" would require a 216" diameter bore, and a flat grind is impossible.

D. Most of the diameter sizes of the abrader stones are not available in stores, so special replacement orders would be expensive.

E. Blade guides are not adjustable to allow for wear and to fit all widths of skate blades.

F. Special tools are needed to change worn abrader stones.

G., H. and I. Meets Optimum Sharpener Specifications.

J. Number of sharpenings before wearing out is very low.

U.S. Pat. No. 5,445,050 of Michael R. Owens

A. Centering and alignment. Does have simple means to approximately center the abrader stone 29 to the skate blade. Manually squeezing the housing 13 and base 15 permits misalignment and inconsistency of the skate hollows.

B. Abrader stone is not rotatable or movable and will produce substandard, erratic skate hollows after just a few sharpenings.

C. Abrader stones are special and not found in retail stores. In fact, they are not available from the supplier suggested in the patent in all convex radii dimensions.

D. Same as C, plus costly because only a small number of accurate sharpenings is possible before disposal and expensive replacement.

E. Does not have adjustable, replaceable blade guides to allow for wear and to fit all blade widths.

F., G. and H. Meets the criteria of these specifications.

J. The number of approximately accurate sharpenings will be fewer than five.

As for the patent's "claims," this device is intended to be disposable, but because of the few true-radius sharpenings possible, this product would be very expensive and not available in most retail stores. In addition, excessive scratching of the blade sides, caused by abrasive pads or stones on the inside of the guides, is very undesirable.

U.S. Pat. No. 5,189,045 of Richard L. Courchesne

This patent is for a very complex device in sharp contrast to most patents. There are many parts: thirty (30) total, with fourteen (14) different identities.

A and B. Has a complicated centering system for various blade widths by way of specially machined shims requiring assembly work for each change. Does not meet the "simple adjustment" requirement. See also E below. The abrader 30 is a long, round metal file which, with a few sharpenings and partial rotations, will lose its accurate centering and produce irregular, off-center hollows in the blades.

C. Reducing the abrader 30 diameter to vary the skate-hollow depth is possible. However, changing to the large diameter file needed to produce a large (e.g., 108") radius would create a monstrous, unwieldy device of approximately 217" in width. Also lacks ability to sharpen to the flat requirement.

D. Abrader files are not standardly available in any hardware stores.

E. Blade guides are not adjustable for various blade widths or for wear. Changes require other than simple tools. In addition, for even a minute blade-thickness variation, shims 40 and 41 are expensive and complicated to change.

F. Does require more than simple, common tools.

G. Is not light in weight and is very bulky too.

H. Has many sharp corners and unnecessary protrusions.

J. Does not produce a large number of sharpenings before replacement of the abrader file is necessary.

U.S. Pat. No. 5,197,232 of Everett Ellsestad

A. This device does not have good centering of the abrader to the guide gap because of the tolerances of Parts 1, 2, 12 & 13 to 4 & 5; and 3 to 6. Also, the remoteness of the center line to the gap-adjusting screws 9 & 10 and the gap 11 can cause flexing of this gap when the skate blade is in place. Hand pressure will cause some tilting of the blade and misalignment of the abrader to the blade, resulting in an off-center blade hollow.

B. After a sharpening, does not maintain exact centering when the abrader cylinder 6 is rotated for a fresh, sharp surface. This cylinder is retained within a U-shaped holder 3. When the abrader is rotated 90 degrees or more, the worn cylinder surface can cause a shift slightly off center relative to the guide gap.

C. Cannot produce skate hollows of all radii required. To produce the larger radii, shallow-hollow sharpening, such as 108", this sharpener would need to be at least 217" across. In addition, the flexible cylinder cannot force the blade hollow to be any specific radius because it will yield to whatever pressure is manually applied to skate and sharpener, thus altering the abrader radius.

D. The cylinder, abrader 6 is not readily obtainable at low cost.

E. Guides for the skate blades are not accurately adjustable for centering per A and B above.

F. No tools needed.

G. Is not lightweight in models requiring large-radius hollows.

H. Has some sharp corners.

I. No problems.

J. Will not sharpen a large number of skates before abrader replacement is needed.

This device is impractical for the above reasons. In addition, the abrader cylinder is so flexible that very little pressure by the user will cause flattening of the hollow in the skate blade.

SUMMARY OF THE INVENTION

This invention is a new-concept, versatile, accurate sharpener for ice skates in particular and also for the runners of iceboats and bobsleds. The device is simple, economical, multipurpose and easy to use by non-technical people, young, old, and in between.

Evaluation of Embodiments #1, #2, and #3

These designs are the only ones to meet nearly 100% of the A through J "Optimum Sharpener Specifications." Embodiment #1 has a solid-material body; Embodiment #2 is based on a sheet-metal concept. Embodiment #3 is similar to Embodiment #1 except adjustable blade guides are replaced by a fixed guide slot in the bottom of the body. The designs of these embodiments are described and documented with detail drawings under "Summary of the Invention" and "Description of the Drawings."

Detailed Assessment of Embodiments #1 and #2 by the A–J Values Above

A. Does have simple means to accurately align the center of the abrader to the center of the skate blade to be sharpened.

B. This abrader is not a long round file, stone or cylinder. It is a flat strip with an abrasive surface on one side. The worn spot does not affect the centering. When worn, the abrader strip is slightly shifted transversely for a fresh surface.

C. Can produce any radius from 0.032" up to and including flat by selecting the radius bar for the shape required. Each radius bar has a fixed, predetermined, permanent convex radius dimension selected by or for the user. Sharpening does not alter this basic accuracy; only the abrader strip wears.

D. The abrader component is a standard, low-cost emery-cloth, etc., available at all hardware stores. The changing of the abrader is simple and does not require tools. Three strips from one 8½"×11" sheet will sharpen about 270 hockey skates.

E. Guides for skate blades are adjustable for any skate width. They are also reversible and replaceable.

F. Only one simple pocket tool, such as a small screwdriver or a nail file, is needed for guides adjustment or parts replacement.

G. The Option #1 sharpener is small and lightweight for all blade widths and hollows. Option #2 is ultra lightweight.

H. Has minimally protruding parts and no sharp edges.

I. All parts—such as washers, nuts, etc.—are standard hardware items.

J. The number of sharpenings possible before abrader replacement is needed is large in quantity: 90 for hockey skates, fewer for figure skates, and more for speed skates.

Detailed Assessment of Embodiment #3 by the A–J Values Above

A. through D. The same as Embodiments #1 and #2.

E. Does not have adjustable, reversible and replaceable guide bars. The blade guide slot is fixed and requires a full body assembly for each width of skate blade.

F. through J. Same as Embodiment #1.

Design Variations of Present Patent Embodiments

Embodiment #2 design is basically the same as Embodiment #1 except that

1. The solid body of Embodiment #1 is replaced a sheet-metal one.

2. The two square nuts in the body of Embodiment #1 are located in individual slots in the side "legs" of the sheet-metal body.

3. The skate guides of Embodiment #2 are fastened to full-length side flanges at the bottom of the body with square nuts and shorter machine screws in place of longer screws that fasten directly into the solid body of Embodiment #1.

4. It is lighter in weight than the embodiment.

Embodiment #3, a simplified design, is the same as Embodiment #1 except that

1. The body 1 is replaced by body 1A, which has an integral bottom section for the fixed blade guide slot 17, replacing the adjustable blade guide bars 3 and associated parts.

2. Slots 14B for the transverse passage of the abrader strip 4 are now part of the body 1A.

BRIEF DESCRIPTION OF THE DRAWINGS

FIG. 5 shows a side elevational view similar to FIG. 3, but with a different embodiment of radius bar.

FIG. 6 shows an end view of FIG. 5.

FIG. 7 shows a top plan view of the sharpener according to a second embodiment.

FIG. 8 shows a cross-sectional view at Y—Y of the sharpener of FIG. 7.

FIG. 9 shows a side elevational view of FIG. 7.

FIGS. 27–28 are top and side views, respectively, of the bracket shown in the embodiment of FIGS. 10–11.

DETAILED DESCRIPTION OF THE INVENTION

This device is a small hand-held and sharpener of the ice-contact surfaces of skate blades or iceboat and bobsled runners, hereinafter called blades. All concave (hollow) radius dimensions and flats can be produced with sharp edges. The main part, the body, may be made of sheet metal and/or solid material with adjustable or non-adjustable blade guides. Common to all embodiments is a longitudinal, central up-from-the-bottom slot between the body's fill-length sides. A "radius bar", about 0.750" high, wider than said blades, about as long as said body, will have a full-length predetermined radius or flat along the narrow top side. The radius bar is slidably (slip-fit) disposed within the vertical body slot. On the body bottom is either a predetermined, non-adjustable, full-length slot, matching the width of the blade to be sharpened, or two full-length guide bars with transverse slots near each end through which pass fastener screws into the body sides. Between the guide bar ends and the body sides are spacers or body projections to create two longitudinal slots through which is transversely disposed a thin, flexible abrader strip such as emery-cloth, etc. On the non-adjustable model these body abrader slots are machined, cast, molded, etc., in the body sides just above the inside of the body bottom. The means for accurately sizing and centering of the gap between the guide bars is by temporary installation between the guide bars of a) the web of the radius bar in an inverted web-down position, or b) centering pins, installed in cooperative holes near each end of any other radius bar. The other end of the pins, with a diameter slidably larger than the width of the blade to be sharpened, project down between the guide bars, which are then squeezed upon the web or pins while the screws are tightened. After removal of the pins or reversal of the radius bar-with-web, the abrader strip is then disposed partially through the two body slots and under the radius bars. Two screws through the top of the body are now tightened, forcing the abrader into it's predetermined radius against the blade guide(s). Sharpening is done by placing the sharpener on the blade and sliding the sharpener back and forth along the blade. As the abrader is worn, the top screws are loosened, the abrader strip is moved slightly to a fresh, unworn surface, and the screws are retightened for more sharpening. One abrader strip will shape and sharpen about 90 blades of hockey skate width. Very low-cost sheets of abrader material are available at most hardware stores.

Figures 1, 2, 3, 4, 12, 13, 14, 15, 16, 17, 18, 19, 20, 21, 22, 23, 24, 25, 26:
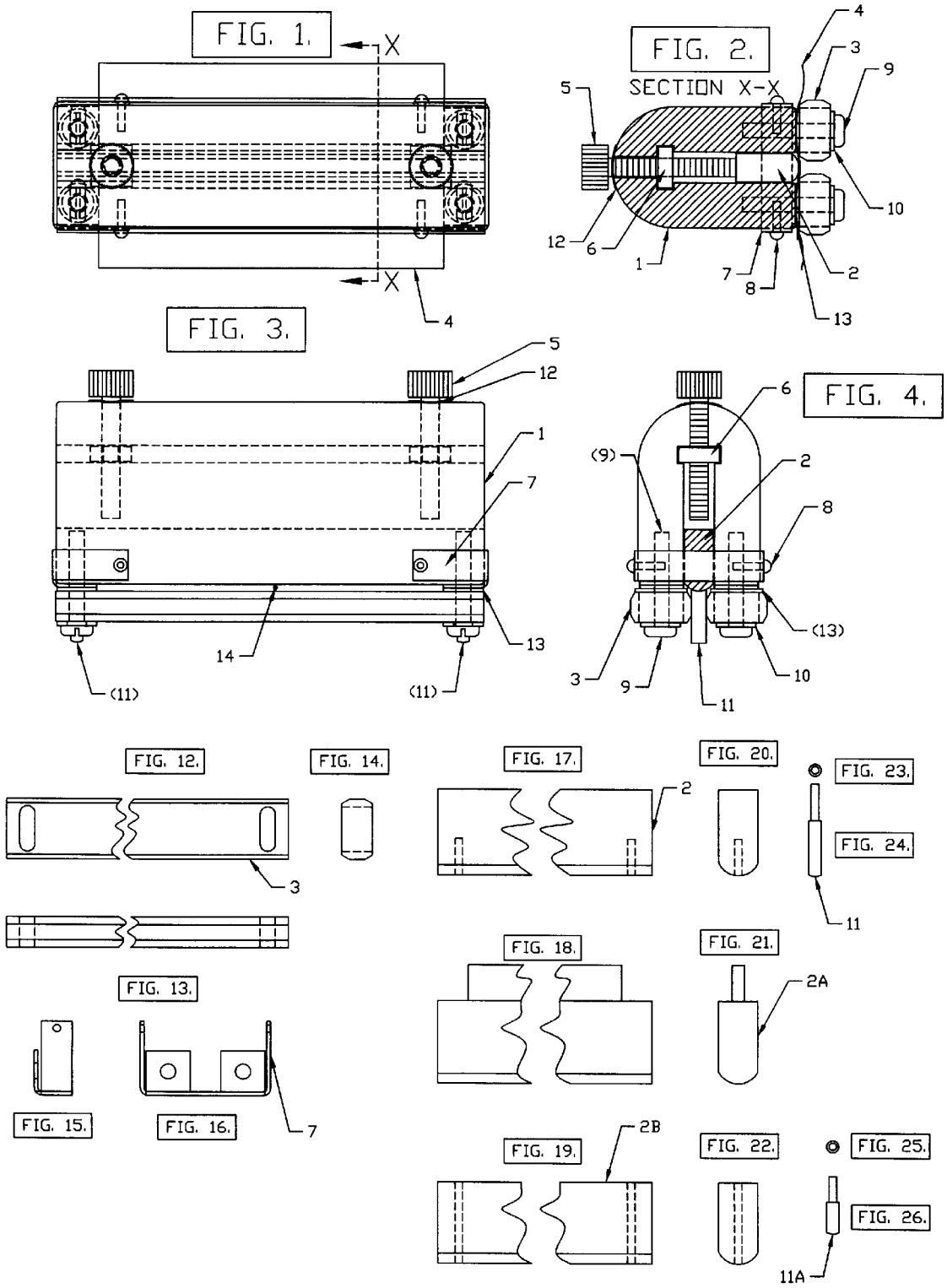
FIG. 1 shows a top plan view of the sharpener according to a first embodiment.
FIG. 2 shows a cross-sectional view at X—X of the sharpener of FIG. 1.
FIG. 3 shows a side elevational view of FIG. 1 with Part 4 removed, and temporary centering pins in place.
FIG. 4 shows an end view of FIG. 3.
FIG. 12 shows a plan view of one of the adjustable guide members.
FIG. 13 shows a side view of one of the adjustable guide members.
FIG. 14 shows an end view of a guide member.
FIG. 15 shows an end elevational view of the bracket shown in the first embodiment.
FIG. 16 shows a plan view of the bracket shown in the first embodiment.
FIGS. 17–19 are side views of various embodiments of radius bar.
FIGS. 20–21 are end views of the radius bar embodiments of FIGS. 17–18, respectively.
FIG. 22 is a sectional view through one of the centering pin holes in the radius bar of FIG. 19.
FIGS. 23–24 represent top and side views, respectively, of a first embodiment of centering pin.
FIGS. 25–26 represent top and side views, respectively, of a second embodiment of centering pin

FIG. 1 shows a top plan view of the sharpener. The abrader strip 4 is a flexible, thin material, with an abrasive coating on one surface next to the skate blade guides 3.

FIG. 2, a cross-sectional view at X—X of FIG. 1, details how this strip 4 is inserted through a slot between the body 1 and the guides 3. Part 1, the body, is of lightweight, solid material, with a full-length slot for standard square-head, threaded nuts 6. A second full-length slot is for the close, slipfit guidance of radius bar 2. The narrow widths of this latter slot and the associated radius bar are always wider than the blades/runners to be sharpened. One standard-width bar and relative body slot will shape/sharpen all widths of ice-skate blades. Part 2 is a full-length radius bar with a convex radius along one narrow edge. This radius dimension is the same as the radius specified for the sharpened hollow in the skate blade minus the thickness of the thin, abrasive strip 4. Parts 3 are the skate guides which are transversely slotted near each end. The slots allow the guides to be adjusted to all skate blade widths and to accurately align the center of the radius bar with the skate blade center. Part 4 is a thin, abrasive strip (emery-cloth, e.g.) formed into the selected radius by the radius bar 2 and the screws 5. Parts 5 are standard, large-head, machine screws, without sockets or slots, inserted through metal sleeves 12 and threaded through nuts 6 in order to apply finger-tight, light pressure on Parts 2, 3, and 4. The nuts 6 are prevented from turning by the sides of the full-length body slot. Parts 7 are sheet-metal brackets that have three purposes: a) as a brace to maintain a positive slip-fit between the body 1 and the radius bar 2; b) as a retainer of the radius bar 2; and c) as part of the spacers between body 1 and blade guides 3. Part 7 plus Part 13 washers create the slot 14 through which the abrasive strip 4 is inserted. Parts 8 are four drive screws that fasten brackets 7 to the body 1. Parts 9 are four slot-head screws that pass through the slots in the guide bars 3 into the body 1. Before tightening these screws, the guides 3 may be adjusted a) to have a gap between them that will match the skate blades to be sharpened and b) to position the center of the gap exactly in the center of the radius bar 2. The screws are then tightened to secure the guides 3.

FIG. 3 presents a front side elevation of FIG. 1 without Part 4 in order to show the slot 14 through which the abrasive strip 4 is inserted. Also shown is one of the radius bars 2 plus temporary centering pins 11.

FIG. 4 provides an end view of FIG. 3 with the centering pin 11 temporarily inserted into the radius bar 2. The large diameter of pin 11 is equal to the width of the skate blade to be sharpened.

To adjust the guides gap to fit the blade to be sharpened, the screws 9 are loosened and the guide bars 3 are manually squeezed together on centering pins 11; screws 9 are tightened. The pins 11 are then removed. An abrasive strip 4 is put through slot 14, the screws 5 are lightly tightened, and the sharpener is ready to use.

To sharpen skates, the sharpener, via the slot between the guides, is placed on the blade and slid back and forth with light pressure.

To move the worn abrader, the screws 5 are loosened, the abrasive strip 4 is moved to a fresh spot, and the screws are tightened again for the next sharpening.

FIG. 5 and FIG. 6 are the same drawings as FIG. 3 and FIG. 4, except for the two optional radius bars and their related "centering" means. The radius bar 2A is an extruded, molded, or machined piece. The integral narrow web shown is nearly the same thickness as the skate blade to be sharpened and is in position to space (gap) the skate guides 3 in the same manner as shown in FIG. 4. The web of this radius bar 2A is partially omitted to allow space for the two downpressure screws 5 when this bar is transferred and inverted 180 degrees to the radius-down sharpening position. The 2B and 11A option is assembled before placing in the "centering" position shown. Unless the width of the skate blade or the bar radius must be changed, this assembly with radius edge down may remain in the sharpener during skate sharpening. Like FIG. 4's pin 11, the larger diameter of pin 11A is about the same width as the blade to be sharpened. To change any feature or dimension of the assembly, the bars 2 and 2A and the bar 2B, with or without pin 11A, may be put in or removed from the sharpener merely by retracting the screws 5 and removing the abrasive strip if it is in place. When sharpening, the strip 4 must have the radius bar held down firmly against it but without such force as to deform the skate blade guides gap or parallelism. Designed with screws 5 without sockets or slots, the device works perfectly with only "finger tightness" pressure.

FIGS. 7, 8, and 9 are of the same design and parts as FIGS. 1, 2, 3, 4, 5, and 6 except for the following:

Body 1A is sheet metal instead of the solid body 1.

Only said radius bar 2B is shown. The other bars 2 and 2A and centering pins 11 and 11A are all optional.

Screws 5A are larger in diameter than screws 5.

Square nuts 6A are larger than nuts 6.

Horizontal slot for nuts 6 in body 1 is replaced by side slots in body 2 to suit change from nut 6 to 6A.

Screws 9A replace longer screws 9.

Spacers 13A replace thinner spacers 13.

Weld marks 15 are added to secure the bottom diagonal brace portion of said body to the vertical body sides. Also shown are the welds to secure the overlapping tabs on each end of the body to hold the side walls in an accurate width and to restrict the longitudinal movement of said radius arbors 2, 2A, and 2B. This latter feature replaces brace 7 and screws 9.

Nuts 16 are an addition.

Figure 10:
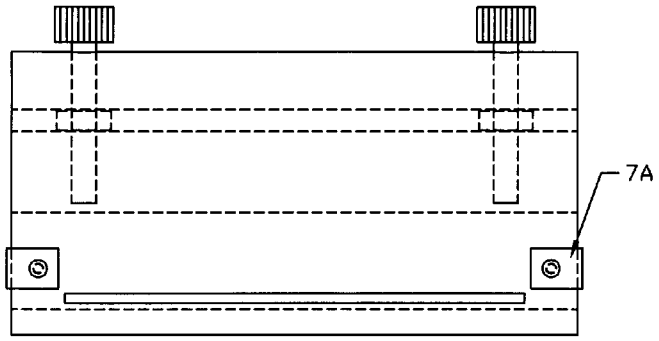
FIG. 10 shows a top plan view of the sharpener according to a third embodiment.
Figure 11:
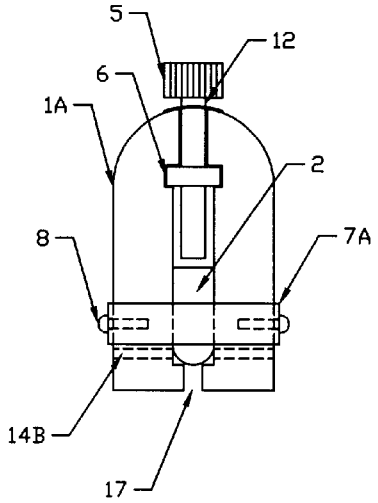
FIG. 11 shows an end view of FIG. 10.

FIGS. 10 and 11 are for a solid-body design, same as FIGS. 1, 2, 3, and 4 except Body 1A replaces body 1 and includes a bottom section.

Blade guide slot 17 replaces blade guides 3 and related parts 9, 10, 11, and 11A. One body blade guide slot width for each blade width Brace 7A replaces brace 7.

Transverse slots 14B are part of body 13 and replaces spacers 13.

Abrader strip 4 is required but not shown.

Miscellaneous features:

a) The close fit between the radius bar and the related body slot is basic and important to the accuracy of the skate blade hollow. Whether body 1 or 1A is reshaped on the outside for weight reduction or flat spaces are added for labels, etc., the center slot is never changed.

b) Embodiment #2's sheet metal design has the same internal slot width, the same interchangeable radius bars, and the same skate-guide centering pins 11 and 11A.

c) Embodiment #3 is a solid-material body design; the adjustable blade guide bars and relative parts are replaced by a fixed guide slot in the bottom of said body.

d) For Embodiments #1, #2, and #3, the long strip of abrader material 4 may be wrapped around the sharpener assembly for pocket or purse carrying.

These above very desirable options suit the needs of the following:

Single skaters with one width blade, one radius hollow;

Individual skaters with one width blade but a variety of hollow radii (as a figure skater would need while practicing for and competing in various events);

Skaters who need radii changes because of skating conditions, such as soft, hard, smooth or rough ice;

Multiple skaters with one width blade but many hollow radius variations required (e.g., a hockey team);

Retail sports stores' inventory and promotional activities.

This small, hand-held device is for the shaping and sharpening of the ice-contact surfaces of skate blades and blade-type runners of bobsleds and iceboats. Unless otherwise noted, all references to blades also apply to runners. All widths and all concave (hollow) radius dimensions from 0.032" up to and including flat can be produced and sharpened. This device has two means of guiding the blades in its sharpening section: a) a fixed, non-adjustable slot in the body and b) adjustable guide bars in a sheet-metal or a solid-material body model. Said device has means for exact centering of the radiused abrader with the center of the skate blade regardless of sharpening wear of the abrader.

I claim:

1. A hand-held skate blade sharpener comprising:

a body having a central longitudinally disposed vertical guide slot defining two side walls;

a radius bar located within said guide slot;

means for vertically adjusting the position of said radius bar within said guide slot;

a longitudinally disposed horizontal slot extending through each side wall of said body;

an abrasive strip extending through said horizontally disposed slots and secured in place against an inner portion of said body by pressure exerted by said vertical adjusting means on said radius bar, said abrasive strip presenting an exposed abrasive surface to a skate blade inserted into said guide slot to allow said blade to be sharpened.

2. A skate blade sharpener according to claim 1 wherein said body further comprises two guide bars, each having transverse slots cooperating with a respective fastening means to allow adjustment of the width of said guide slot.

3. A skate blade sharpener according to claim 1 wherein said sharpener further includes at least one pin insertable into said guide slot for setting the width of said guide slot.

4. A skate blade sharpener according to claim 1 wherein said sharpener further includes a web insertable into said guide slot for setting the width of said guide slot.

5. A skate blade sharpener according to claim 1 wherein said body is formed of sheet metal.

* * * * *